US008360641B2

(12) United States Patent
Kim

(10) Patent No.: US 8,360,641 B2
(45) Date of Patent: Jan. 29, 2013

(54) AIR BAG WITH CONTINUOUS HEAT RESISTANCE MATERIAL

(75) Inventor: Sung Jun Kim, Gunpo-si (KR)

(73) Assignee: INDIS AIR Corp., Seoul (KR)

( * ) Notice: Subject to any disclaimer, the term of this patent is extended or adjusted under 35 U.S.C. 154(b) by 331 days.

(21) Appl. No.: 12/598,772

(22) PCT Filed: Nov. 18, 2008

(86) PCT No.: PCT/KR2008/006785

§ 371 (c)(1),
(2), (4) Date: Nov. 4, 2009

(87) PCT Pub. No.: WO2010/024498

PCT Pub. Date: Mar. 4, 2010

(65) Prior Publication Data

US 2010/0239189 A1 Sep. 23, 2010

(30) Foreign Application Priority Data

Aug. 25, 2008 (KR) ..... 10-2008-0082838

(51) Int. Cl.
*B65D 30/00* (2006.01)
*B65D 30/24* (2006.01)
*B65D 30/26* (2006.01)
*B65D 81/02* (2006.01)

(52) U.S. Cl. ..... 383/3; 383/43; 383/44; 206/522

(58) Field of Classification Search ..... 383/3, 43, 383/44; 206/522
See application file for complete search history.

(56) References Cited

U.S. PATENT DOCUMENTS 4,793,123 A * 12/1988 Pharo ..... 53/449
4,918,904 A * 4/1990 Pharo ..... 53/472
5,240,112 A * 8/1993 Newburger ..... 206/524.8
5,427,830 A * 6/1995 Pharo ..... 428/35.2
5,772,034 A * 6/1998 Lin ..... 206/522
5,853,247 A * 12/1998 Shroyer ..... 383/95
6,283,296 B1 * 9/2001 Newman ..... 206/522
(Continued)

FOREIGN PATENT DOCUMENTS

JP 2005-162268 6/2005
JP 2007-238177 9/2007

OTHER PUBLICATIONS

International Search Report for corresponding application No. PCT/KR2008/06785 dated Jul. 14, 2009.

*Primary Examiner* — Nathan J Newhouse
*Assistant Examiner* — Nina Attel
(74) *Attorney, Agent, or Firm* — Renner, Otto, Boisselle & Sklar, LLP

(57) ABSTRACT

An air bag includes two inner sheets facing each other, heat resistance materials located between the two inner sheets and applied to any one inner sheet in its length direction, two outer sheets located outside the two inner sheets, a second thermal bonding line thermally bonding the inner and outer sheets along the heat resistance materials, a first thermal bonding line thermally bonding the two outer sheets with gap from the second thermal bonding line to form an air input channel, and third thermal bonding lines extending from the second thermal bonding line oppositely to the channel to form air pillars, at least two heat resistance materials being continuously formed over the pillars, an air injected through the channel being introduced into the pillars between the two inner sheets, and the two inner sheets positioned in the pillars being adhered and pressed to any one outer sheet by an inner pressure of the pillars.

5 Claims, 7 Drawing Sheets

U.S. PATENT DOCUMENTS

| | | | | |
|---|---|---|---|---|
| 6,729,110 | B2 * | 5/2004 | Sperry et al. | 53/503 |
| 7,201,273 | B2 * | 4/2007 | Chen et al. | 206/522 |
| 2007/0186993 | A1 * | 8/2007 | Koyanagi | 141/114 |
| 2008/0044109 | A1 | 2/2008 | Liao et al. | |
| 2008/0080792 | A1 * | 4/2008 | Liao et al. | 383/3 |
| 2008/0095474 | A1 * | 4/2008 | Liao et al. | 383/3 |

* cited by examiner

AIR BAG WITH CONTINUOUS HEAT RESISTANCE MATERIAL

TECHNICAL FIELD

This disclosure relates to an air bag, and more particularly to an air bag with excellent workability in which a continuous heat resistance material is formed in inner sheets to decrease machining errors at thermal bonding points and regions of sheets.

BACKGROUND ART

During delivery of household necessaries or other important articles, the contents are wrapped by an air bag so as to prevent the contents from being damaged by external impacts.

In the appended drawings, FIG. 1 is a perspective view showing a general air bag, FIG. 2 is a vertical sectional view taken along the line A-A of FIG. 1, which shows a valve of the air bag shown in FIG. 1, and FIG. 3 is a plan view showing a valve of the air bag to which air is not injected.

As shown in FIG. 1, the air bag 10 has a valve 20 that is closed by an inner pressure of air injected into the air bag.

Hereinafter, the general air bag is explained in detail.

The air bag 10 has a rectangular structure, and an air input channel 11 is formed along one side of the air bag 10. Also, a plurality of air pillars 13 are perpendicularly formed with respect to the air input channel 11. A plurality of valves 20 respectively connect the air input channel 11 to the air pillars 13, so air supplied through the air input channel 11 is introduced to each air pillar 13 through the valves 20. If the air pillars 13 are filled with air, inner pressure is generated to press the valves 20, thereby sealing the air pillars 13 such that the air in the air pillars 13 does not go out through the valves 20.

Referring to FIGS. 1 to 3, the air bag 10 includes two outer sheets 15 that form an overall configuration of the air bag. Also, the valve 20 is formed by two inner sheets 21 positioned inside the two outer sheets 15, a plurality of thermal bonding lines 31, 32, 33, and thermal bonding points 41, 42.

As shown in FIGS. 1 to 3, a plurality of heat resistance inks 23 are discontinuously applied to any one of facing surfaces of the two inner sheets 21 in a length direction thereof. Here, the length direction of the inner sheets means a direction perpendicular to the thermal bonding line 33. Each heat resistance ink 23 is formed to cover the air input channel 11 and the air pillar 13 with respect to the thermal bonding line 32.

In a state that the two inner sheets 21 are positioned in the two outer sheets 15, the air input channel 11 is formed by a first thermal bonding line 31 and a second thermal bonding line 32, positioned in parallel with each other. The second thermal bonding line 32 is formed while passing the heat resistance inks 23 discontinuously formed along the inner sheets 21. And, the first thermal bonding line 31 bonds only the two outer sheets 15.

The air input channel 11 is formed along the first thermal bonding line 31 and the second thermal bonding line 32 as mentioned above, and one side of the air input channel 11 is closed by thermal bonding and the other side is opened. Air is injected through the other side that is open.

Meanwhile, the outer sheet 15 and the inner sheet 21 are bonded by the second thermal bonding line 32, but regions where the heat resistance inks 23 are formed are not bonded. Thus, the air injected through the air input channel 11 is introduced to the air pillars 13 through passages 25 between the inner sheets 21, which are not thermally bonded due to the heat resistance inks 23.

In addition, the air pillars 13 are formed by third thermal bonding lines 33 extending perpendicularly from the second thermal bonding line 32. The third thermal bonding lines 23 are alternately formed with the passages 25 formed by the heat resistance inks 23. In other words, one passage 25 is formed with respect to one air pillar 13 by means of the discontinuously applied heat resistance inks 23. The air introduced to the air pillar 13 through the passage 25 fills the air pillar 13 formed by the third thermal bonding line 33.

Meanwhile, in a region of two inner sheets 21 positioned toward the air input channel 11 with respect to the second thermal bonding line 32, one inner sheet 21 and one outer sheet 15 are bonded and fixed to each other by means of the first thermal bonding point 41. As two outer sheets 15 are expanded due to the injected air, the inner sheets 21 bonded and fixed by the first thermal bonding point 41 become wider in opposite directions to open the passage 25.

However, the two inner sheets 21 positioned toward the air pillar 13 with respect to the second thermal bonding line 32 are bonded and fixed to any one outer sheet by the second thermal bonding point 42 to close the valve 20 by the air filled in the air pillar 13.

Thus, when air is injected to the air input channel 11, the air is introduced to the air pillars 13 through the passages 25, and the passages 25 are closed due to the inner pressure of the air pillars 13.

In the air bag described above, the discontinuously applied heat resistance inks 23 should be respectively matched with the air pillars 13 at accurate locations. However, while thermal bonding lines and thermal bonding points are formed in four sheets, deviation of location may occur in any sheet. Also, the sheets may be expanded due to the heat caused by thermal bonding, so it is difficult to form thermal bonding lines and thermal bonding points such that heat resistance inks are in accurate correspondence to air pillars. Due to this difficulty, workability is deteriorated, and an inferiority rate is increased.

DISCLOSURE

Technical Problem

The disclosure is designed to solve the above problems, and therefore the disclosure is directed to providing an air bag in which a heat resistance material is continuously formed in a length direction of valve to ensure less strictness in locations of thermal bonding lines and thermal bonding points and thus to allow easier thermal bonding work, improved productivity and decreased inferiority rate.

The disclosure is also directed to providing an air bag having a double sealing structure, which minimizes leakage of air.

The disclosure is also directed to providing an air bag in which an air input channel is expanded in the same direction as the direction in which the valve is opened when air is injected, thereby facilitating easy injection of air.

Technical Solution

In one aspect, there is provided an air bag, which includes two inner sheets positioned to face each other, heat resistance materials located at an inner side of the two inner sheets and applied to any one of the inner sheets in a length direction thereof, two outer sheets respectively located at an outer side of the two inner sheets, a second thermal bonding line for thermally bonding the inner sheets and the outer sheets along the heat resistance materials, a first thermal bonding line for thermally bonding the two outer sheets with a gap from the second thermal bonding line to form an air input channel, and third thermal bonding lines extending from the second thermal bonding line in a direction opposite to the air input channel to form air pillars, wherein the heat resistance material is continuously formed over at least two air pillars, and wherein an air injected through the air input channel is introduced into the air pillars through a gap between the two inner sheets, and the two inner sheets positioned in the air pillars are closely adhered and pressed to any one of the outer sheets by means of an inner pressure of the air pillars.

Also, in one embodiment, a second thermal bonding portion may extend in a lateral direction from the third thermal bonding line, and the extending second thermal bonding portion may be spaced apart from another second thermal bonding portion extending from adjacent another third thermal bonding line, thereby forming a second passage.

Also, in one embodiment, fourth thermal bonding lines with shorter lengths than intervals of the third thermal bonding lines may extend in a lateral direction from the third thermal bonding lines, and the fourth thermal bonding lines may thermally bond the two inner sheets to any one of the outer sheets, and the fourth thermal bonding lines may be formed in an opposite side to the second thermal bonding line, with respect to the second thermal bonding line.

Also, in one embodiment, a plurality of first thermal bonding portions may be formed in the air input channel in correspondence to the third thermal bonding lines, respectively, such that adjacent first thermal bonding portions being spaced apart from each other to form a first passage, and a part of the first thermal bonding portions may thermally bond the two outer sheets, and the other part of the first thermal bonding portions may thermally bond the outer sheets to the inner sheets.

Also, in one embodiment, at least two thermal bonding points for thermally bonding the two outer sheets in a direction perpendicular to the air pillars may be formed at a middle of each air pillar in a length direction thereof.

Also, in one embodiment, both ends of the air input channel may be closed, and a cock may be formed at any one of the outer sheets corresponding to the air input channel.

ADVANTAGEOUS EFFECTS

As described above, the air bag disclosed herein may improve productivity and lower an inferiority rate since a heat resistance ink is applied over the entire length of a valve to ensure less strictness in locations where thermal bonding lines and thermal bonding points are formed and thus allow easier thermal bonding work.

Also, the air bag disclosed herein seals the air filled in the air pillars with a double sealing structure to minimize leakage of air, thereby ensuring excellent durability.

In addition, the air bag disclosed herein ensures smooth widening of the passage since the air input channel is expanded in the same direction as the direction in which the passage is widened when air is injected. Thus, air may be more easily injected through the smoothly widened passage, thereby ensuring improved productivity.

DESCRIPTION OF DRAWINGS

The above and other aspects, features and advantages of the disclosed exemplary embodiments will be more apparent from the following detailed description taken in conjunction with the accompanying drawings in which.

REFERENCE NUMERALS OF ESSENTIAL PARTS IN THE DRAWINGS

Figure 1:
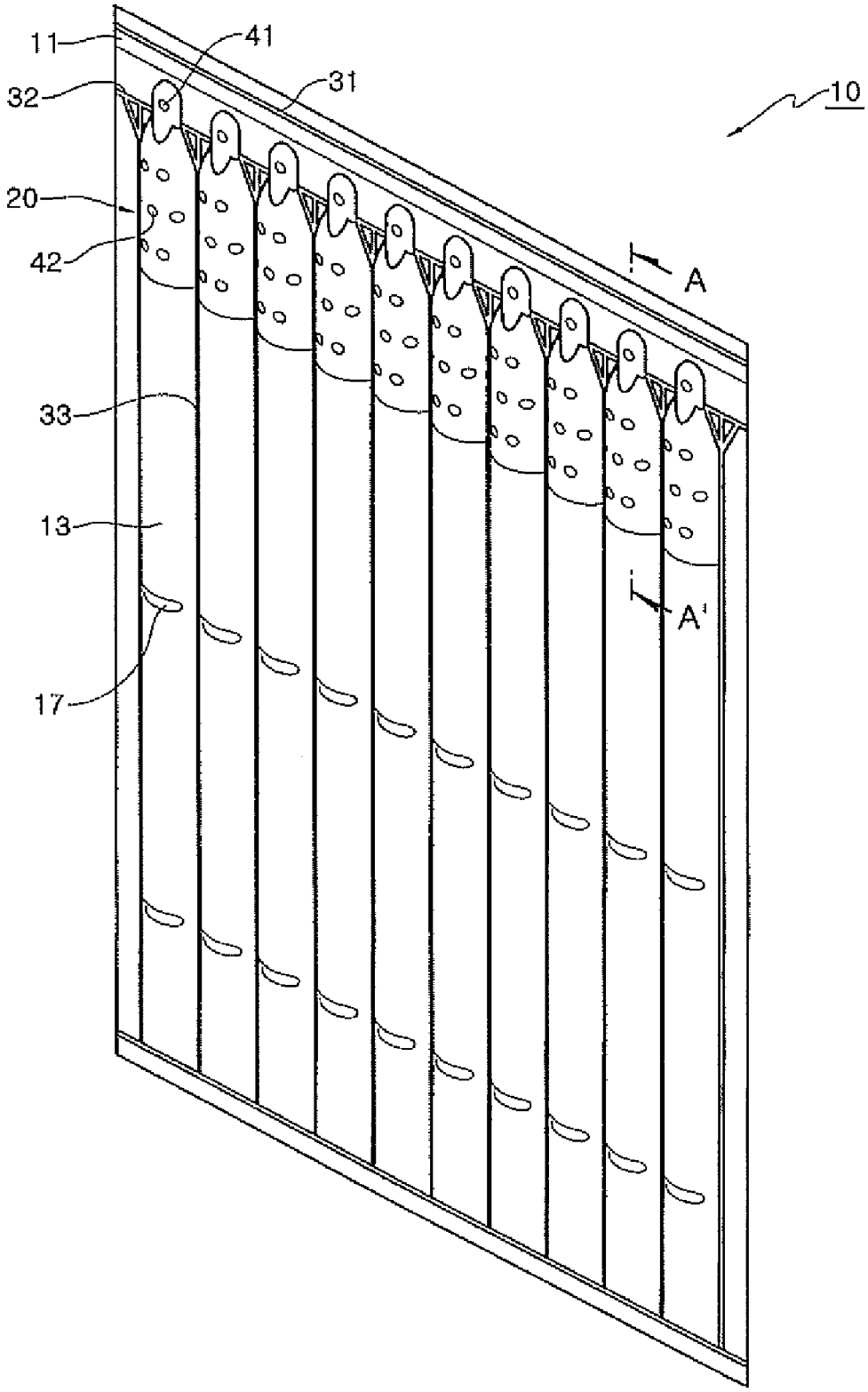
FIG. 1 is a perspective view showing a general air bag.

100: air bag 101: air input channel
103: air pillar 105: outer sheet
120: valve 121: inner sheet
140: heat resistance ink 125A: first passage
125B: second passage 131-134: thermal bonding line
151, 152: thermal bonding portion 139: thermal bonding point
160: pressurization space 170: cock

BEST MODE

Hereinafter, preferred embodiments of the present invention will be described. While the present invention is described with reference to embodiments thereof, the technical idea and the construction and operation of the invention are not limited to the embodiments.

Figure 4:
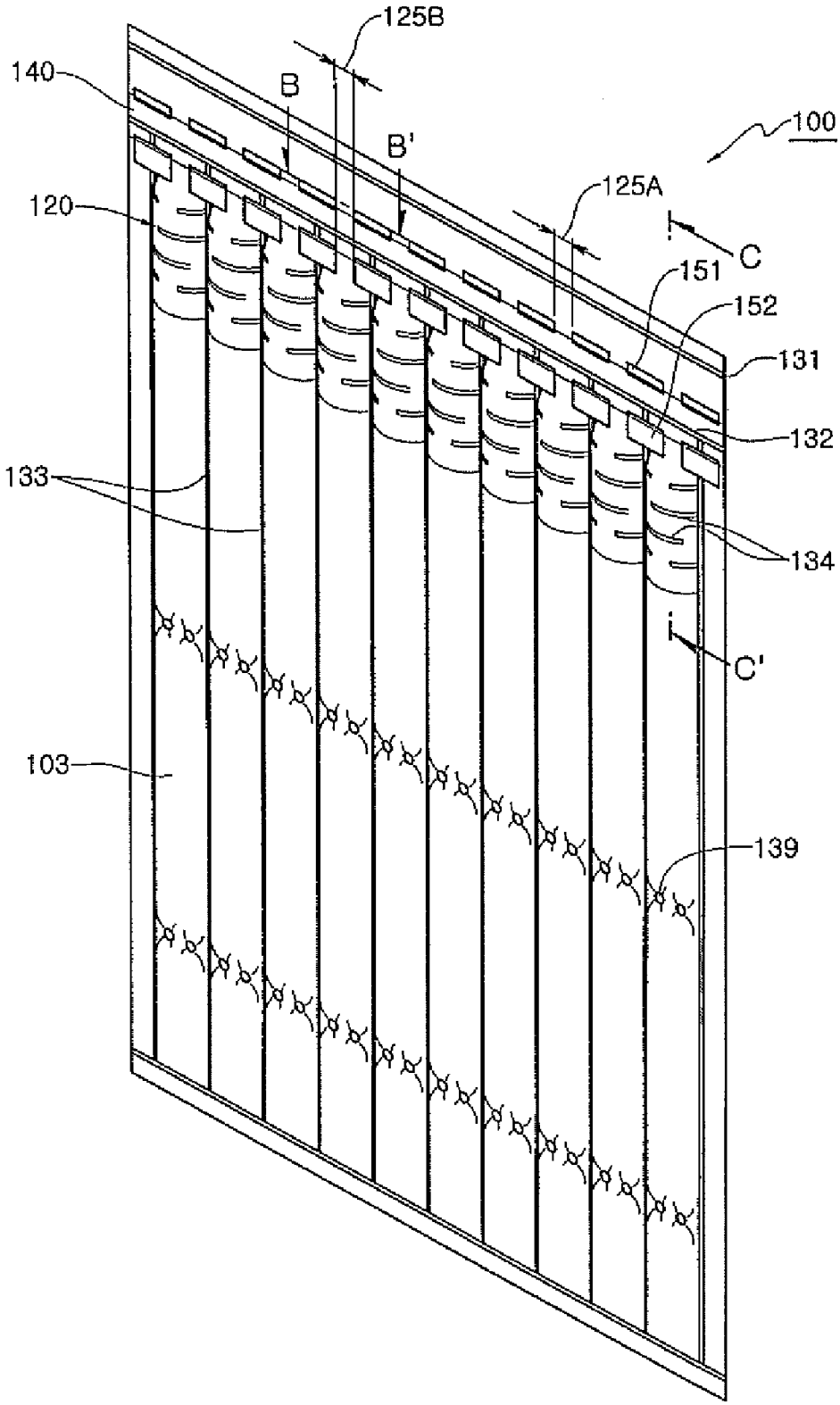
FIG. 4 is a perspective view showing one embodiment of an air bag disclosed herein.
Figure 5:
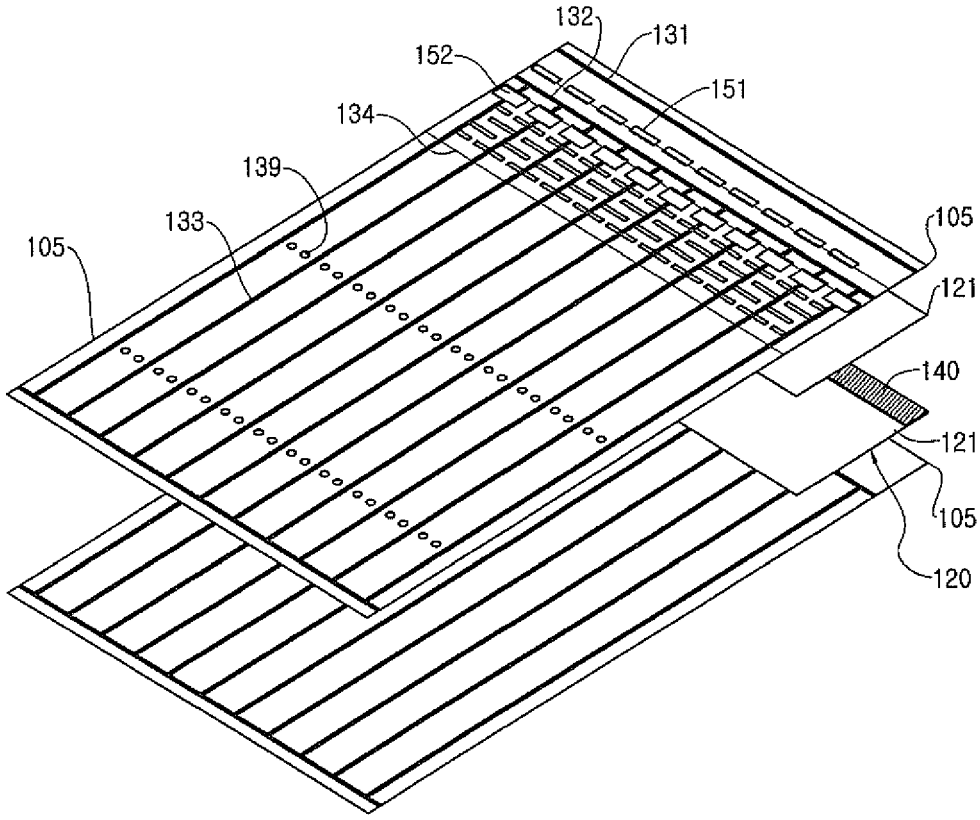
FIG. 5 is a perspective view illustrating a process of making the air bag shown in FIG. 4.
Figure 6:
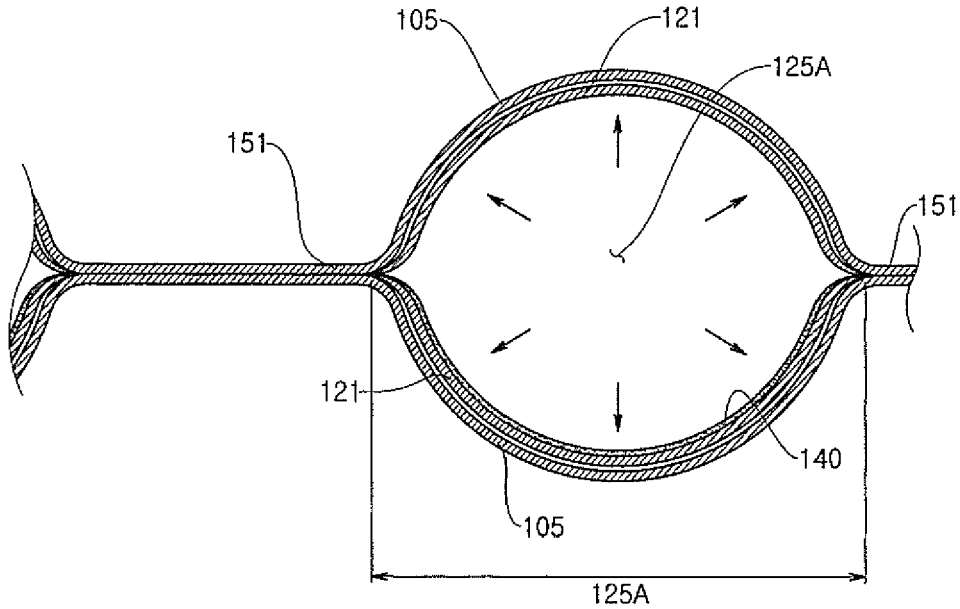
FIG. 6 is a sectional view taken along the line B-B' of FIG. 4, which illustrates expansion of an air input channel and widening of a first passage by a thermal bonding portion shown in FIG. 4.
Figure 7:
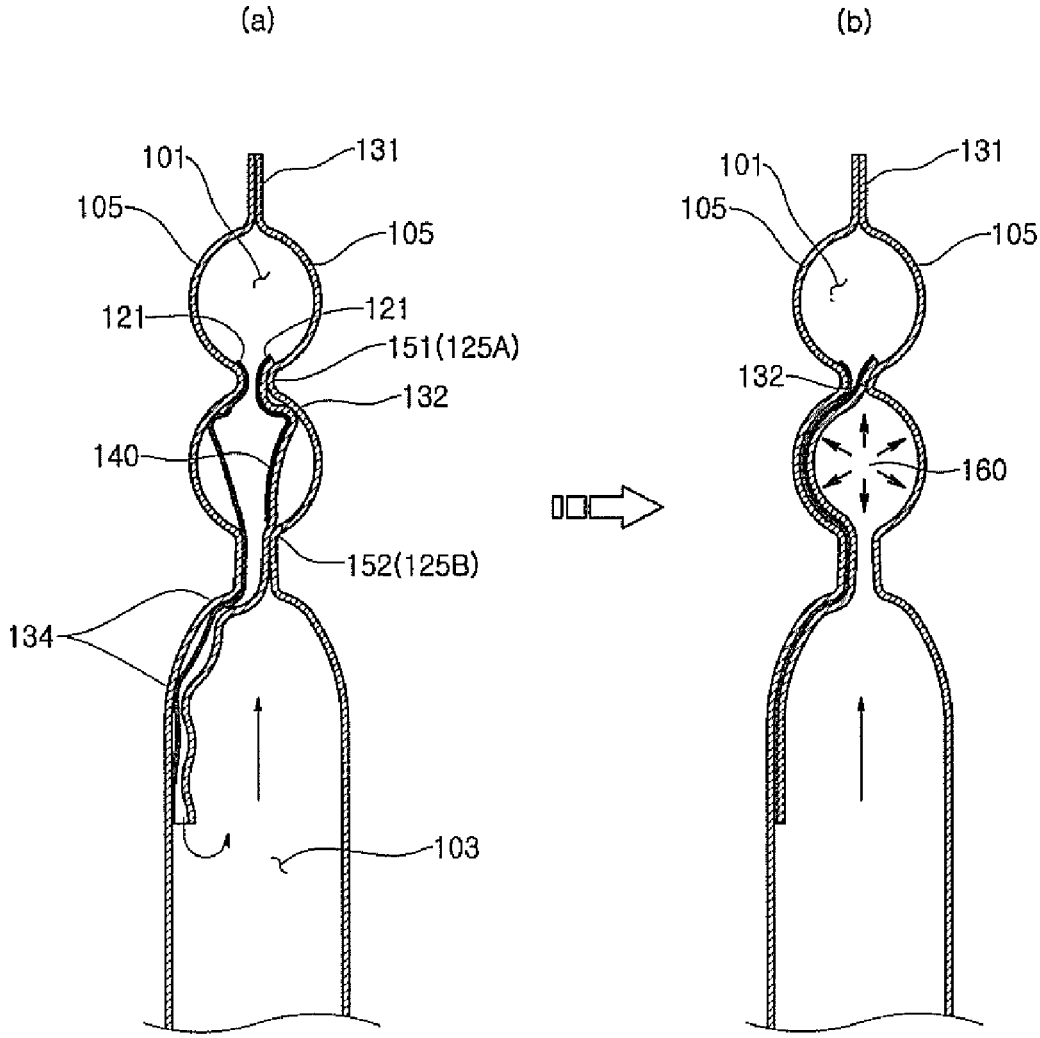
FIG. 7 is a vertical sectional view taken along the line C-C' of FIG. 4, which illustrates a valve while and after the process of injecting air to the air bag shown in FIG. 4 is executed.
Figure 8:
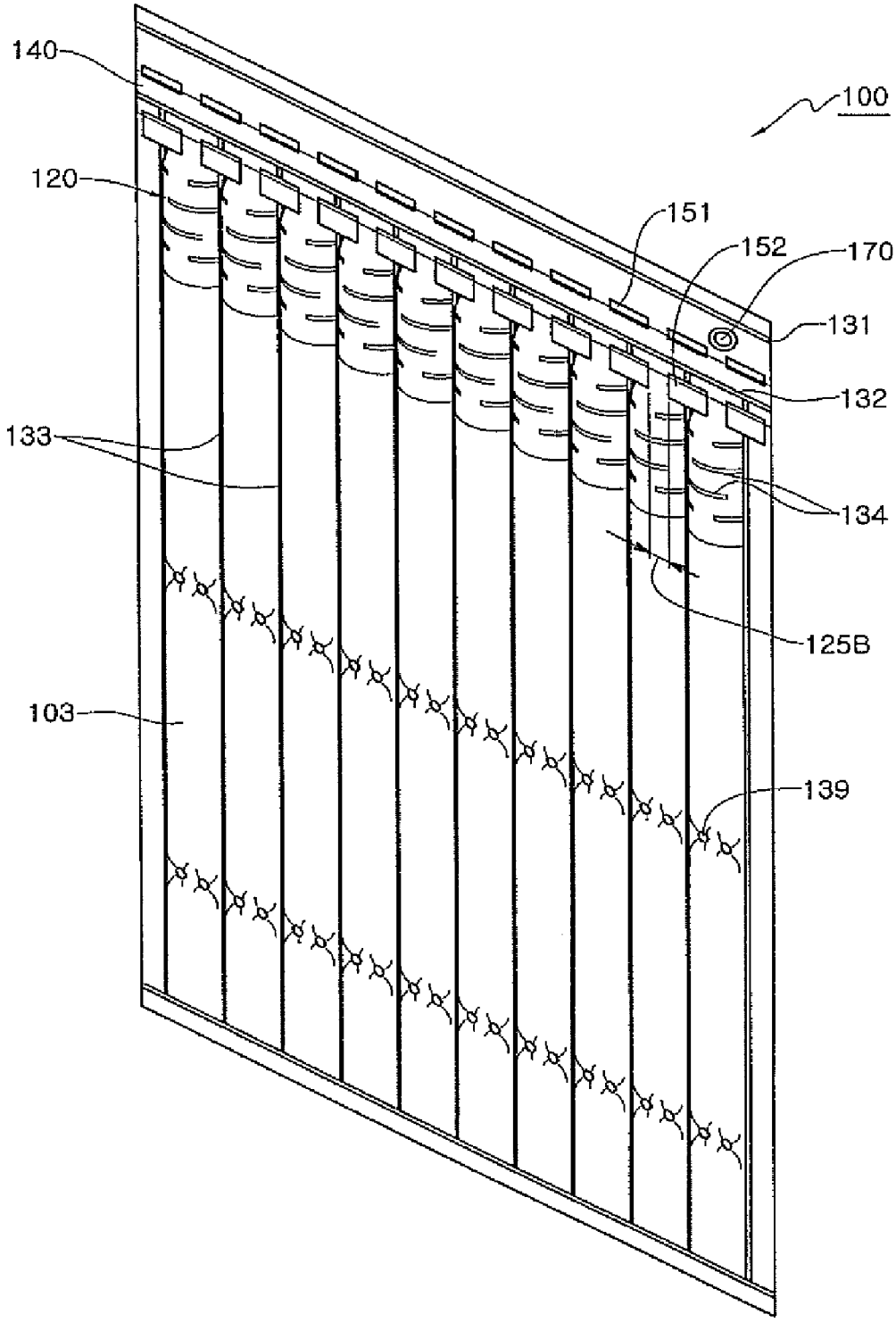
FIG. 8 is a plan view showing another embodiment of an air bag disclosed herein, to which a cock is mounted.

FIG. 4 is a perspective view showing one embodiment of an air bag disclosed herein, and FIG. 5 is a perspective view illustrating a process of making the air bag shown in FIG. 4. FIG. 6 is a sectional view taken along the line B-B' of FIG. 4, which illustrates expansion of an air input channel and widening of a first passage by a thermal bonding portion shown in FIG. 4, FIG. 7 is a vertical sectional view taken along the line C-C' of FIG. 4, which illustrates a valve while and after the process of injecting air to the air bag shown in FIG. 4 is executed, and FIG. 8 is a plan view showing another embodiment of an air bag disclosed herein, to which a cock is mounted.

As shown in FIGS. 4 and 5, an air bag 100 of this embodiment includes two outer sheets 105, two inner sheets 121 that forms a valve 120, and a first thermal bonding line 131 and a second thermal bonding line 132 that form an air input channel 101. Also, the air bag of this embodiment includes a third thermal bonding line 133 perpendicularly extending from the second thermal bonding line 132 to form an air pillar 103, a fourth thermal bonding line 134 for elongating a passage of air passing through the valve 120 to improve sealing, a second thermal bonding portion 152 for double sealing, and a first thermal bonding portion 151 formed to facilitate widening of the valve 120. A heat resistance ink 140 is applied to an end of an inner side of any one of the two inner sheets 121 in a length direction of the inner sheet. Here, the length direction of the inner sheet means a direction perpendicular to the third thermal bonding line 133, namely a direction perpendicular to a length direction of the air pillar 103. The heat resistance ink 140 may be applied over at least two air pillars substantially continuously, and the heat resistance ink is substantially continuously applied over all air pillars of the air bag 100 in this embodiment.

Here, the fourth thermal bonding lines 134 are formed to cross the third thermal bonding line 133 and thermally bond the two inner sheets 121 to any one of the outer sheets to form an elongated path of air passing through the valve 120. Thus, it is possible to prevent air from being leaked reversely, thereby improving sealing.

The second thermal bonding portion 152 is a thermal bonding region formed with a greater thickness than the first to fourth thermal bonding lines 131, 132, 133, 134, thus it has smaller length than a gap between the third thermal bonding lines. The second thermal bonding portion 152 is formed to cross the third thermal bonding line 133 between the second thermal bonding line 132 and the fourth thermal bonding line 134.

In addition, the first thermal bonding portion 151 is discontinuously formed between the first thermal bonding line 131 and the second thermal bonding line 132 in correspondence to the third thermal bonding line 133, and it is formed at an end of the inner sheet coated with the heat resistance ink 140. A part of the first thermal bonding portion 151 thermally bonds the two outer sheets 105, and the other part of the first thermal bonding portion 151 thermally bonds the two outer sheets 105 and the two inner sheets 121. Here, a gap between the first thermal bonding portions 151 is called "a first passage 125A".

Since the heat resistance ink 140 is continuously applied to an end of the inner sheets 121 and the second thermal bonding line 132 is formed along the heat resistance ink 140, the third thermal bonding line 133 may be connected to any point of the second thermal bonding line 132. Also, a gap between the third thermal lines 133 is opened due to the heat resistance ink 140, and air may be easily injected into the air pillar 103 formed by the third thermal bonding line 133.

In addition, the second thermal bonding portion 152 thermally bonds the two outer sheets 105 and the two inner sheets 121, and it is formed with a gap (hereinafter, referred to as "a second passage 125B") from an adjacent second thermal bonding portion 152 formed to cross each third thermal bonding line 133. Thus, the air filled in the air pillar 103 is introduced between the inner sheet which is bonded by the fourth thermal bonding line 134 and the outer sheet which is not bonded to the inner sheet by the fourth thermal bonding line 13, and then introduced between the second thermal bonding portion 152 and the second thermal bonding line 132 through the second passage 125B. The introduced air presses two inner sheets 121 toward any one outer sheet 105 in a space (hereinafter, referred to as "a pressurization space 160") between the second thermal bonding portion 152 and the second thermal bonding line 132. In this configuration, since the second thermal bonding portion 152 is formed, the air filled in the air pillar 103 primarily presses the two inner sheets 121 to any one outer sheet below the second thermal bonding portion 152 before passing through the second passage 125B. Also, the air passes through the second passage 125B as explained above and then secondarily presses the two inner sheets 121 to any one outer sheet in the pressurization space 160. In other words, as the second thermal bonding portion 152 is formed, a double sealing structure is made. Due to such a double sealing structure, it is possible to minimize leakage of air filled in the air pillar 103.

Hereinafter, an air bag configured as above and a method for making the air bag will be explained in more detail.

As shown in FIG. 5, the two inner sheets 121 are positioned on one outer sheet 105, and the fourth thermal bonding line 134 is formed such that the two inner sheets 121 are fixed to the one outer sheet 105. Then, the other outer sheet 105 is placed to cover the two inner sheets 121. Here, the heat resistance ink 140 is located at an inner portion of the overlapped inner sheets.

Then, an air input channel 101 is formed. The air input channel 101 is made by forming the first thermal bonding line 131 and the second thermal bonding line 132. The first thermal bonding line 131 is formed in parallel along a length direction of the valve 120 just by thermally bonding the two outer sheets 105. Also, the second thermal bonding line 132 extends in parallel with the first thermal bonding line 131 continuously along the heat resistance ink 140. At this time, the two inner sheets 121 are not bonded to each other due to the heat resistance ink 140, but the outer sheet 105 is bonded to the inner sheet 121.

In this state, the third thermal bonding line 133, the first thermal bonding portion 151 and the second thermal bonding portion 152 may be formed at the same time by molding or formed in any order according to work conditions. The forming order may be changed.

The third thermal bonding line 133 perpendicularly extends with respect to the second thermal bonding line 132 to form a sealed air pillar 103. Here, the third thermal bonding line 133 formed at a region where the inner sheet 121 is located thermally bonds all of the two inner sheets 121 and the two outer sheets 105, and the third thermal bonding line 133 formed at a region where the inner sheet 121 is not located thermally bonds only the two outer sheets. The third thermal bonding line 133 formed at a region where the heat resistance ink 140 is located bonds only the inner sheet 121 and the outer sheet 105 because of the heat resistance ink 140 but does not bond the inner sheets 121 with each other.

Also, the second thermal bonding portion 152 is formed on and across the third thermal bonding line 133 and formed between the fourth thermal bonding line 134 and the second thermal bonding line 132. The second thermal bonding portion 152 is spaced apart from the second thermal bonding portion 152 formed on an adjacent third thermal bonding line 133 to form the second passage 125B through which air may be introduced to the air pillar 103.

Meanwhile, the first thermal bonding portion 151 is formed between the first thermal bonding line 131 and the second thermal bonding line 132, namely at the air input channel 101, and the first thermal bonding portion 151 is formed at an end of the inner sheet 121 in correspondence to the third thermal bonding line 133, namely at an end where the heat resistance ink 140 is applied. Thus, a part of the first thermal bonding portion 151 located at an inner side of the heat resistance ink 140 thermally bonds the inner sheet 121 to the outer sheet, and the other part of the first thermal bonding portion 151 located at an outer side of the inner sheet 121 thermally bonds only the outer sheets 105. Here, a gap between the first thermal bonding portions 151 is the first passage 125A.

Meanwhile, one end of the air input channel 101 is closed, and the other end of the air input channel 101 at an opposite side to the air pillar 103 where the valve 120 is positioned is closed. Thus, as air is introduced into the air pillar 103 through the valve 120, the air pillar 103 is expanded.

Figure 2:
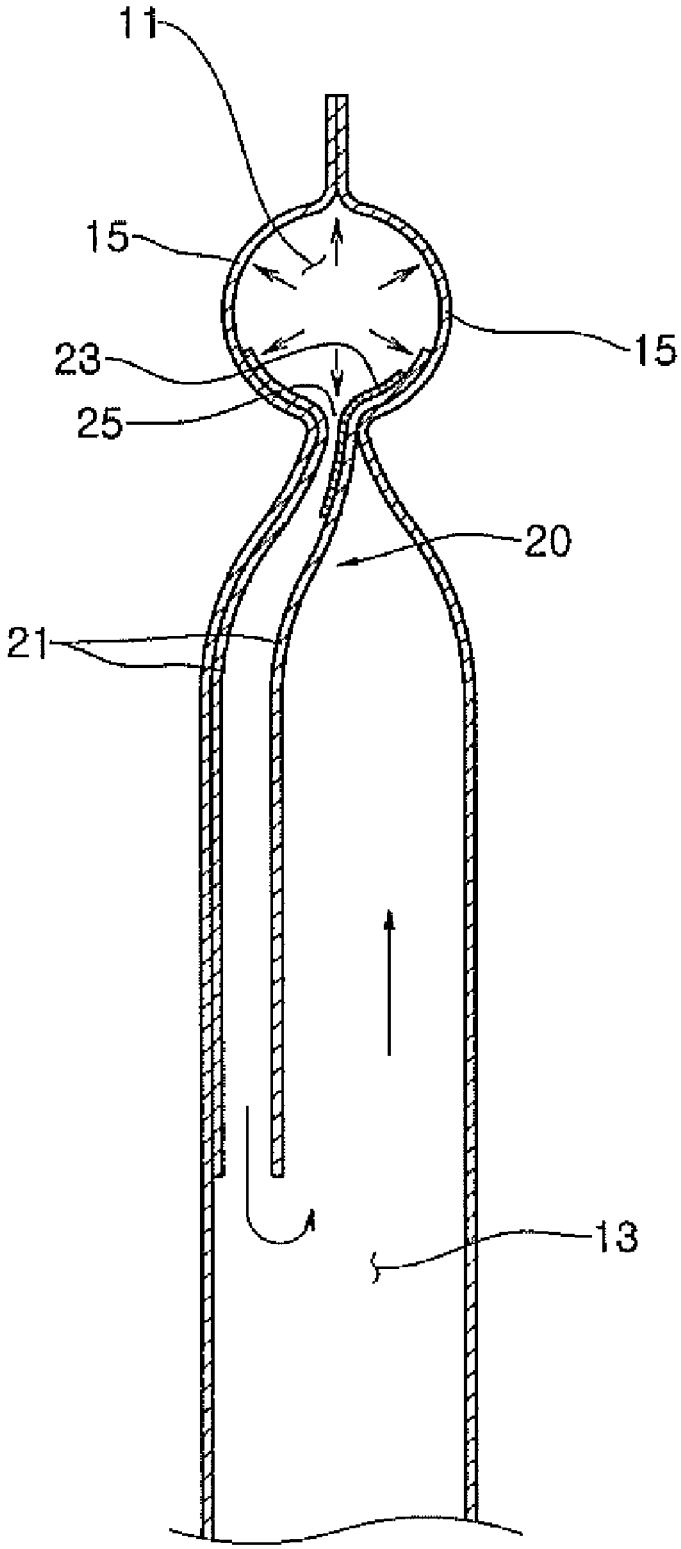
FIG. 2 is a vertical sectional view taken along the line A-A' of FIG. 1, which shows a valve of the air bag shown in FIG. 1.
Figure 3:
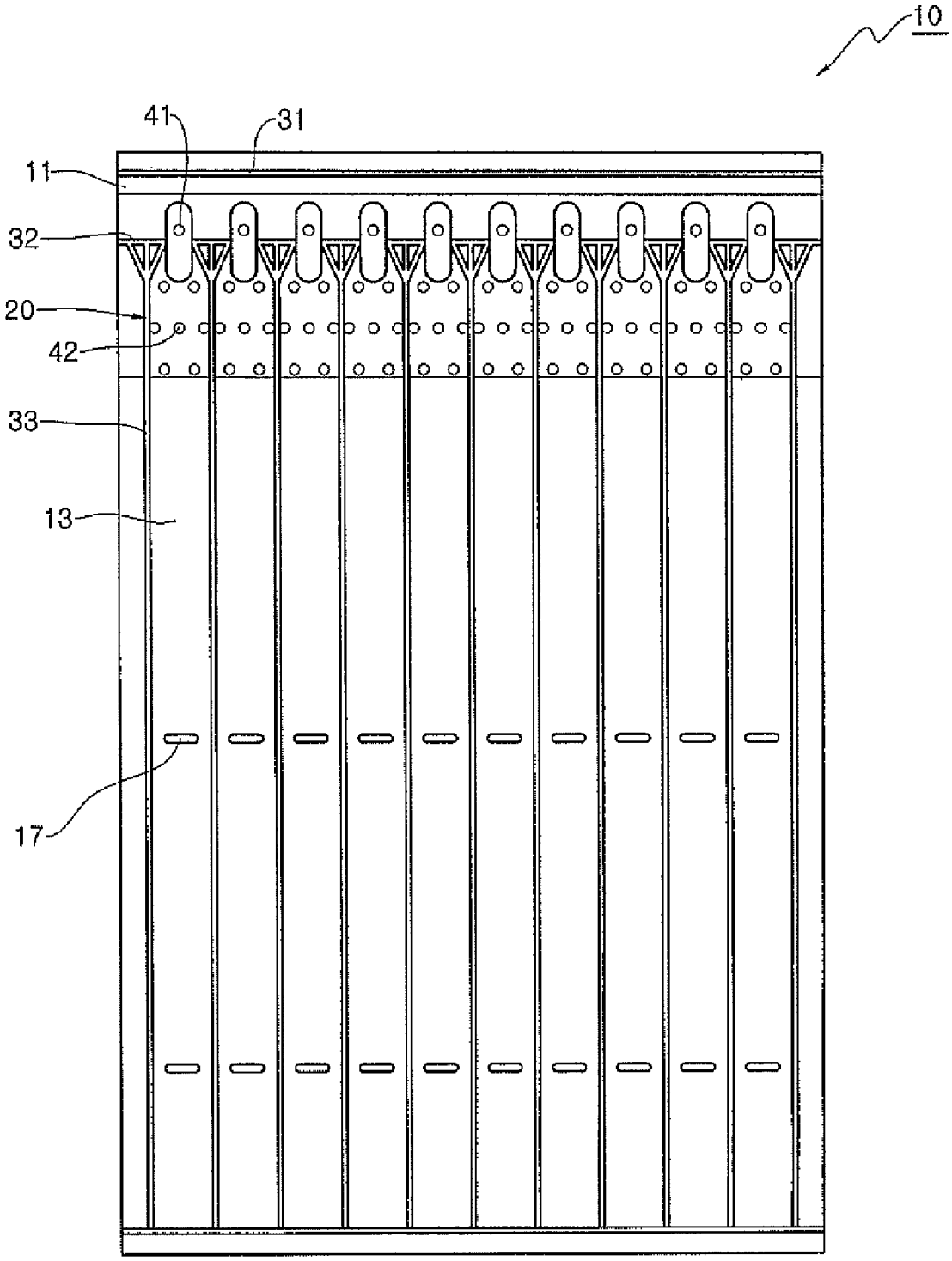
FIG. 3 is a plan view showing the valve when air is not injected to the air bag.

Referring to FIGS. 1 to 3, a general air bag should be configured such that a plurality of heat resistance inks 23 discontinuously formed are corresponding to thermal bonding lines and points 33, 41, 42, which form air pillars 13. To make the heat resistance inks 23 correspond to the thermal bonding lines and points 33, 41, 42, a method of sensing locations of the heat resistance inks 23 is generally used. In other words, locations of the discontinuously formed heat resistance inks 23 are checked using a sensor, and locations to form thermal bonding lines and points 33, 41, 42 are adjusted with respect to the location information of the checked heat resistance inks 23.

If the locations of the heat resistance inks 23 are checked using a sensor as mentioned above, an entire production process may be interrupted in case the sensor malfunctions. Also, a sensing process and a process of finely adjusting the locations of the thermal bonding lines and points 33, 41, 42 according to the sensing results are added to the production procedure. Thus, working errors may occur during a working process, and thus the entire workability is deteriorated. Also, since thermal bonding lines and points 33, 41, 42 are formed in four sheets, any one sheet may be pushed from its correct location, and the sheets may expand due to the heat caused by thermal bonding. Thus, it is difficult to locate heat resistance inks in correspondence to air pillars and to form thermal bonding lines and points at accurate positions, so an inferiority rate of products is increased.

In addition, in case that it is intended to produce products with various sizes by increasing or decreasing width of the air pillars 13 of a general air bag, intervals between the heat resistance inks 23 applied in accordance with the width of the air pillar 13 should also be adjusted. Thus, an inner sheet 21 to which the heat resistance inks 23 are applied should be separately prepared in accordance with the width of the air pillar 13, namely in accordance with the size of an air bag to be produced, so production costs are increased and productivity is deteriorated.

Differently from a general air bag in which heat resistance materials are discontinuously applied to each air pillar, in the air bag of this embodiment, the heat resistance ink 140 is applied continuously over at least two air pillars 103. Thus, without consideration of the coating location of the heat resistance ink 140, the air bag 100 may provide excellent sealing just by forming the thermal bonding lines and portions 133, 134, 151, 152 at predetermined intervals. In other words, the thermal bonding lines and portions 133, 134, 151, 152 may be simply formed at predetermined locations without separately sensing location of the heat resistance ink 140, so working errors occurring while adjusting or deciding locations of the thermal bonding lines and portions 133, 134, 151, 152 are reduced and also an inferiority rate of products is decreased. In addition, in case that it is intended to produce an air bag 100 with an increased width of the air pillars 103, what is needed is just to increase intervals of the thermal bonding lines and portions 133, 134, 151, 152. Thus, there is no need of separately preparing an inner sheet 121, so production costs are decreased.

Hereinafter, an air flow while air is injected to the air input channel 101 of the air bag configured as mentioned above is explained.

As seen from FIG. 7, if air is injected to the air input channel 101 formed between the first thermal bonding line 131 and the second thermal bonding line 132 using an air injector, the air is injected along the air input channel 101 to expand the air input channel 101.

If the air input channel 101 is expanded as mentioned above, the two inner sheets 121 are respectively bonded to the outer sheets 105 due to the first thermal bonding portion 151, so a gap between the two inner sheets 121 is widened to form the first passage 125A. The air is introduced through the first passage 125A beyond the second thermal bonding line 132 into the valve 120 between the third thermal bonding lines 133.

Meanwhile, the air introduced into the valve 120, namely between the two inner sheets 121, passes through the second passage 125B between the second thermal bonding portions 152. After that, the air flows along a path formed by the fourth thermal bonding line 134 and as a result flows into the air pillar 103 through the valve 120.

The air introduced into the air pillar 103 as mentioned above expands the air pillar 103 and increases an inner pressure of the air pillar 103. If the air pillar 103 is expanded, the two inner sheets 121 are closely adhered to any one of the outer sheets thermally bonded by the fourth thermal bonding line 134. At this time, the pressure of air is applied toward the outer sheet to which the two inner sheets 121 are thermally bonded, thereby closing the valve 120. The air pressure is concentrated on a curved region formed just below the location of the second thermal bonding portion 152, than a flat portion, thereby giving a primary sealing effect.

If the inner pressure of the air pillar 103 is further increased in this state, the air flows into the pressurization space 160 through the second passage 125B of the second thermal bonding portions 152. Also, the air introduced into the pressurization space 160 presses the two inner sheets 121 in the pressurization space 160 toward any one of the outer sheets, thereby giving a secondary sealing effect. Here, the air pressure is more concentrated on a curved region of the outer sheet expanded by a thermally bonded region, such as a region below the second thermal bonding line 132 and above the second thermal bonding portion 152, than on a flat portion of the expanded outer sheet 105.

It is because the curved region has a larger surface area than the flat portion, so pressure is more greatly applied to the curved region. Thus, sealing is more excellent as there are more curved regions. In this principle, as the valve 120 is expanded by air, the second thermal bonding portion 152 may further improve a sealing property by forming more curved regions where air pressure is concentrated.

Meanwhile, when air is injected to the air input channel 101, a part of the first thermal bonding portion 151 thermally bonds the two outer sheets 105, and the other part of the first thermal bonding portion 151 thermally bonds the two outer sheets 105 and the two inner sheets 121. Thus, as seen from FIG. 6, while air is introduced through the first passage 125A, a direction in which the first passage 125A is expanded is identical to a direction in which the valve 120, namely the two inner sheets 121, is widened. Thus, the pressure applied to the first passage 125A gives a force to open the valve 120, so the valve 120 is smoothly opened by the first passage 125A.

In a general air bag 10, an expanding direction of the air input channel 11 is perpendicular to an expanding direction of the passage 25, so an air pressure is not uniformly applied when widening the passage 25. Thus, the passage 25 has an oval shape in which a major axis is relatively longer than a minor axis. However, in the air bag of this embodiment, an expanding direction between the first thermal bonding portions 151 is identical to a widening direction of the first passage 125A, so the first passage 125A is widened in a substantially circular shape, differently from the above.

In addition, in a general air bag 10, a thermal bonding point 41 is formed such that air introduced into the air input channel 11 may easily flow in the passage 25. Due to the thermal bonding point 41, one inner sheet 21 and one outer sheet 15 are bonded and fixed to each other. As the two outer sheets 15 are expanded due to air, the inner sheets 21 respectively bonded and fixed by the first thermal bonding point 41 are widened in opposite directions, thereby opening the passage 25. For this operation of the thermal bonding point 41, the thermal bonding point 41 should be formed at a region where the heat resistance ink 23 is applied. However, since the heat resistance inks 23 are discontinuously formed, a working error may occur while the thermal bonding point 41 is formed. This working error is another factor of increasing an inferiority rate.

In this embodiment, the first thermal bonding portion 151 is formed such that the first passage 125A may be smoothly opened, so there is no need of forming a thermal bonding point 41 that should be formed after a positioning process for deciding accurate location as in the general air bag, and thus an inferiority rate is decreased.

Components that may be added to the air bag of this embodiment will be explained in detail.

As seen from FIG. 7, two inner sheets 121 have different thicknesses from each other. Among the two inner sheets 121 bonded to any one of the outer sheets by the fourth thermal bonding line 134, an inner sheet located in an inner side has a smaller thickness, and the other inner sheet has a relatively greater thickness. This configuration helps to improve sealing. This effect is obtained since the two inner sheets have different thicknesses. Thus, even when an inner sheet located in an inner side has a greater thickness than an inner sheet located in an outer side, the sealing property is also improved.

In addition, thermal bonding points 139 are formed with intervals in a direction perpendicular to the air pillar 103 in the middle of the air pillar 103 in its length direction. The thermal bonding points 139 play a role of a folding line along which the air pillar 103 may be folded. Two or three thermal bonding points 139 may be formed per one air pillar 103.

In a general air bag 10, a folding line 17 is formed in a width direction of the air pillar 13. The folding line 17 does not entirely close the air pillar 13 such that air may flow in the air pillar 13, but the folding line 17 reduces an inner space of the air pillar 13, so the air pillar 13 may be easily folded with respect to the folding line 17. This folding line 17 should be positioned at a width center of the air pillar 13. If the folding line 17 leans in one direction, an inner space in an opposite side is wider, so it is difficult to fold the air pillar 13.

However, if the air bag 10 is pushed from its accurate location when the folding line 17 is formed, the folding line 17 may be frequently biased in one side, not located at a width center of the air pillar 13.

In this embodiment, intervals of the thermal bonding points 139 are kept uniformly such that two or three thermal bonding points 139 may be formed in one air pillar 103. Thus, even when the air bag 100 is pushed while the thermal bonding points 139 are formed, the inner space of the air pillar 103 may be more uniformly reduced. In this way, the air pillar 103 may be easily folded due to the thermal bonding points 139.

Meanwhile, the air input channel 101 explained above has one closed side and the other open side, so an air injector is inserted into the other open side to inject air therein. However, as shown in FIG. 8, it is also possible that both ends of the air input channel 101 are closed, but a cock 170 is formed in any one of the outer sheets 105 corresponding to the air input channel 101. In this case, an air injector is closely adhered to the cock 170 and then injects air into the air input channel 101.

INDUSTRIAL APPLICABILITY

The air bag disclosed herein ensures high productivity and low inferiority rate along with excellent durability, and also it may be used for packaging various articles.

The invention claimed is:

1. An air bag, comprising:

two inner sheets positioned to face each other;

heat resistance material located at an inner side of the two inner sheets and applied to any one of the inner sheets in a length direction thereof;

two outer sheets respectively located at an outer side of the two inner sheets;

a second thermal bonding line for thermally bonding the inner sheets and the outer sheets along the heat resistance material;

a first thermal bonding line for thermally bonding the two outer sheets with a gap from the second thermal bonding line to form an air input channel; and third thermal bonding lines extending from the second thermal bonding line in a direction opposite to the air input channel to form air pillars, wherein the heat resistance material is continuously formed over at least two of the air pillars, wherein an air injected through the air input channel is introduced into the air pillars between the two inner sheets, and the two inner sheets positioned in the air pillars are closely adhered and pressed to any one of the outer sheets by means of an inner pressure of the air pillars, wherein a plurality of first thermal bonding portions are formed in the air input channel in correspondence to the third thermal bonding lines, respectively, such that adjacent first thermal bonding portions are spaced apart from each other to form a first passage, and wherein a part of the first thermal bonding portions thermally bond the two outer sheets, and the other part of the first thermal bonding portions thermally bond the outer sheets to the inner sheets.

2. The air bag according to claim 1, wherein a second thermal bonding portion extends in a lateral direction from the third thermal bonding line, and the extending second thermal bonding portion is spaced apart from another second thermal bonding portion extending from adjacent another third thermal bonding line, thereby forming a second passage.

3. The air bag according to claim 2, wherein fourth thermal bonding lines with shorter lengths than intervals of the third thermal bonding lines extend in a lateral direction from the third thermal bonding lines, and wherein the fourth thermal bonding lines thermally bond the two inner sheets to any one of the outer sheets, and the fourth thermal bonding lines are formed in an opposite side to the second thermal bonding line, with respect to the second thermal bonding portion.

4. The air bag according to claim 1, wherein at least two thermal bonding points for thermally bonding the two outer sheets in a direction perpendicular to the air pillars are formed at a middle of each air pillar in a length direction thereof.

5. The air bag according to claim 1, wherein both ends of the air input channel are closed, and a cock is formed at any one of the outer sheets corresponding to the air input channel.

* * * * *